US005372544A

United States Patent [19]

Gervais

[11] Patent Number: 5,372,544

[45] Date of Patent: Dec. 13, 1994

[54] AIR DUCT

[76] Inventor: Hubert Gervais, 29 Portneuf, P.O. Box 841, R.R. No. 1, Cantley, Quebec, Canada, J0X 1L0

[21] Appl. No.: 2,857

[22] Filed: Jan. 21, 1993

[51] Int. Cl.[5] ..... F24F 11/02

[52] U.S. Cl. ..... 454/256; 454/271

[58] Field of Search ..... 137/487.5; 454/194, 454/256, 271, 273, 284, 289, 290, 347, 350, 351, 352

[56] References Cited

U.S. PATENT DOCUMENTS

| | | | |
|---|---|---|---|
| 4,394,958 | 7/1983 | Whitney et al. | 454/290 X |
| 4,557,418 | 12/1985 | Leemhuis | 236/493 |
| 5,081,913 | 1/1992 | Gervais | 454/359 X |

*Primary Examiner*—Harold Joyce

*Attorney, Agent, or Firm*—David J. French

[57] ABSTRACT

An automatic ventilator closure which operates on the basis of a pressure differential condition within the conduit is provided with an air flow detector to ensure that the control system for the closure does not cycle. The pressure sensor and air flow detector are both in the form of vanes that are integrally connected to each other.

4 Claims, 3 Drawing Sheets

AIR DUCT

FIELD OF THE INVENTION

This invention concerns the automatic opening and closing of air vent outlets and inlets. More particularly, it applies to the detection of a pressure differential condition in an exhaust outlet or air inlet in order to activate the opening of a door or flap.

BACKGROUND OF THE INVENTION

This invention involves an improvement in the invention disclosed in U.S. Pat. No. 5,081,913 issued Jan. 21, 1992. That invention was directed to an automatic mechanism for opening and closing an air exhaust outlet, according to whether or not air is being exhausted or ventilated therethrough.

Thus, in accordance with the prior invention, when an exhaust fan turns on and creates an over-pressure condition in the air exhaust conduit, the pressure sensing means will be activated. In the preferred embodiment, the pressure sensing means is a vane which swings in response to an over-pressure to close an air bleed outlet, activating a first switch which supplies current to a motor. The motor, will then open the conduit closure or flap. Once the flap is fully open, an interlock means interrupts the flow of current to the motor and holds the conduit closure in a static, "open" mode.

With the flap fully open the over-pressure condition in the conduit may fall in strength and the vane may erroneously indicate that the flap should no longer be in the fully open position. It is for this reason that the prior patent indicates that the this pressure sensing means may be combined with an air flow sensing means so as to keep the said first switch in the static, open mode if air flow is detected simultaneously with only a minimal over-pressure condition.

When the exhaust fan stops, the over-pressure condition in the conduit will drop and the air flow will stop. This causes both the pressure and air flow sensing means to be deactivated. In the preferred embodiment the pressure-sensing means will move, under a spring or gravity bias, to a second position wherein the bleed outlet is open. By this action the electrical interlock holding the conduit closure in its "open" state is over-ridden and a second switching means commences to provide current to the motor in a manner which causes the flap on the conduit to shut.

A second interlock means is provided to interrupt the flow of current to the motor, once the closure means on the conduit is in a fully closed condition. This second interlock may itself be over-ridden and combined with the first switch means to permit current to flow to the motor means, in a closure-opening direction, once the pressure-sensing means is reactivated by a resumption of over-pressure to its first closure-opening position.

The cited prior patent describes a pressure detection mechanism that relies upon a swinging vane that is responsive to an over-pressure condition between the interior of a conduit and the region outside. Reference is also made to an air-flow detecting vane operating in parallel with the pressure detecting vane to control the closing and opening of the closure of the conduit.

This present invention relates to an improvement in the inter-relationship between the two vanes used to control these actions.

The invention in its general form will first be described, and then its implementation in terms of specific embodiments will be detailed with references to the drawings following hereafter. These embodiments are intended to demonstrate the principle of the invention, and the manner of its implementation. The invention will then be further described, and defined, in each of the individual claims which conclude this Specification.

SUMMARY OF THE INVENTION

According to the invention, a closure system for a ventilation conduit having a closure comprises:

(1) a motor and source of electrical current for such motor;

(2) electrical switch means capable of switching the current to the motor to effect either opening or closing conditions for the closure;

(3) switch actuation means comprising:

(a) a bleed-outlet formed in the conduit through which air tends to pass when a pressure differential condition exists between the interior of the conduit and the exterior;

(b) a pressure-sensing vane for actuating said switch means positioned to swing in relation to the bleed outlet between a first, pressure-differential detecting position, and a second, non-pressure-differential position; and (c) an air flow sensing vane which is positioned to detect the presence or absence of air flow within said conduit, said air flow sensing vane being integrally attached to said pressure-sensing vane so as bias the pressure-sensing vane towards the pressure-differential detecting position when air flow is present within the conduit whereby the electrical switch means is activated by the pressure-sensing vane to activate said motor means.

The foregoing summarizes the principal features of the invention. The invention may be further understood by the description of the preferred embodiments, in conjunction with the drawings, which now follow.

SUMMARY OF THE PREFERRED EMBODIMENTS

Figure 1:
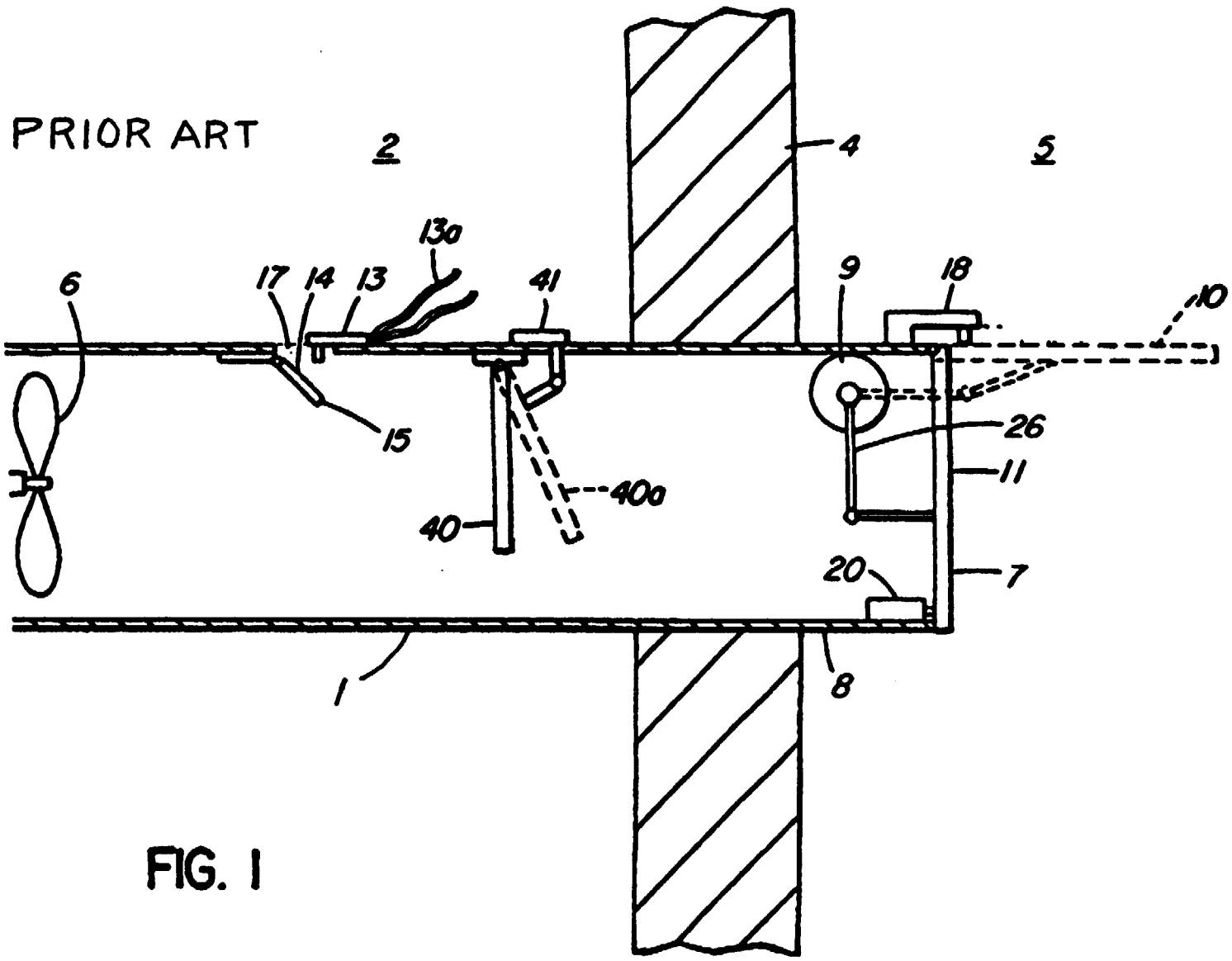
FIG. 1 is a schematic drawing of the prior art system with a conduit passing through the wall of a structure where it terminates in a motor controlled closure with the prior art controls in place.
Figure 3A:
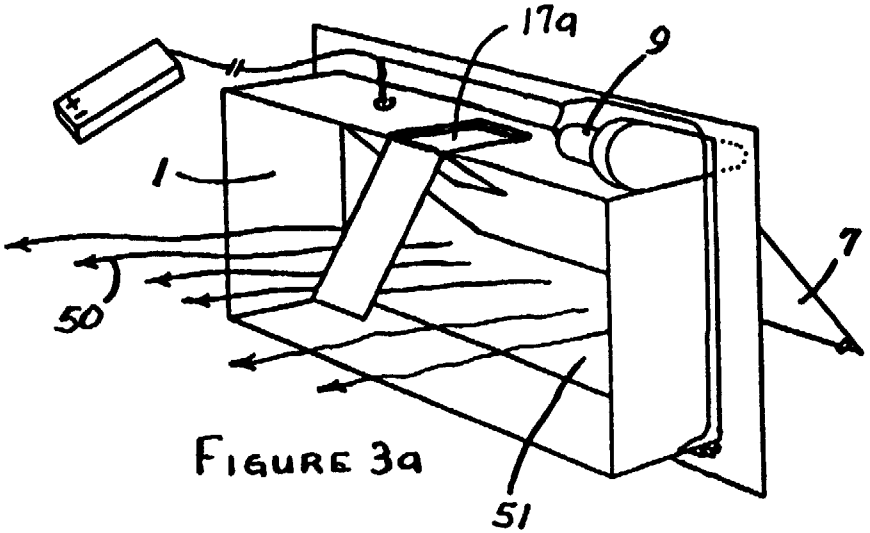
FIGS. 3*a* and 3*b* are perspective views of the conduit closure unit of FIGS. 2*a,b* with the door or flap in an open condition.
Figure 3B:
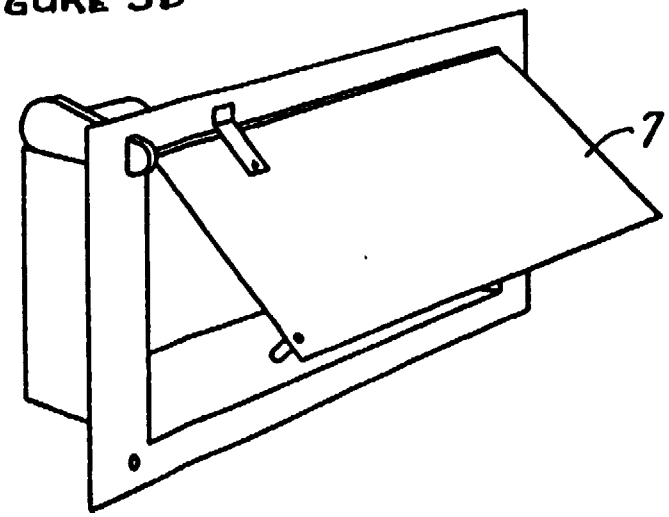

In the prior art arrangement of FIG. 1 a conduit 1 passes from the interior 2 of a structure through a wall 4 to the exterior 5. A source of air, such as a fan 6, intermittently supplies air, under pressure, to the conduit 1.

A closure 7 in the form of a cover is positioned at the exterior end 8 of the conduit 1 as it exits the wall 4. The closure 7 may optionally be in the form of a swinging door or flap, or may be based on a series of rotatable slats. A motor 9 is positioned to rotate the closure 7 between open 10 and closed 11 positions through hinged linkage 26.

Current for the motor 9 is provided from a power source (not shown in FIG. 1), which may be a battery, through wires leading to a first pressure sensing switch 13*a*.

The pressure-sensing vane 14 can move between open 15 and closed 16 positions. In the open position 15 a bleed-outlet 17 through the conduit 1 is exposed. In the closed position 16, this bleed-outlet 17 is covered by the vane 14 which functions as a bleed-outlet flap.

When the fan 6 shuts down, the over-pressure and air flow condition will disappear. The vane 14 is biased by its own weight, or a spring, to fall away from the bleed-outlet 17. Once in its second or open position 15 the second pole of the pressure sensing switch 13*a* is activated to provide current to the motor 9 through wires bypassing the first electrical switch.

The closure-effecting poles of the pressure sensing switch 13*a* operate in complementary fashion. Each pole routes current to the motor 9 so as to correspondingly rotate the closure 7 between the open 10 and closed positions 11.

In the prior disclosure it was proposed to mount a separate swinging air flow detecting means, in the form of vane 40 in the path of air flow within the conduit. This was thought useful because when the closure is opened, the pressure differential between the exterior region 5 and the interior 2 of the conduit 1, may drop, causing the pressure sensing vane to incorrectly signal that the closure should be shut. In some cases a cycling action may arise. The air flow vane 40 removes any uncertainty as to whether the closure should remain open, by detecting the presence of the air flow and providing a signal to such effect.

According to the present invention this prior invention, suitably modified, may be applied in a situation both where a conduit is being used for exhaust air from a structure, and to draw air into a structure. An example of the latter situation would be a conduit providing a draft of outside air for a furnace or fireplace within a building. In such a case the pressure differential arising from the low pressure condition within the building structure, and within the conduit, can be used to control the opening and closing of the closure.

Such an arrangement is shown in FIGS. 2*a*, 2*b* and 3*a*, 3*b* wherein upon opening of the closure 7, air flow 50 may enter through the opening 51 within the conduit 1.

In both cases, where air is being exhausted or is being drawn into a structure, it has been found useful to mount the swinging air flow detecting vane 40 integrally with the pressure sensing vane 14. This is shown in FIGS. 2–5 wherein an externally mounted air vent closure system is depicted that incorporates the integrally formed vanes.

Figures 4, 5:
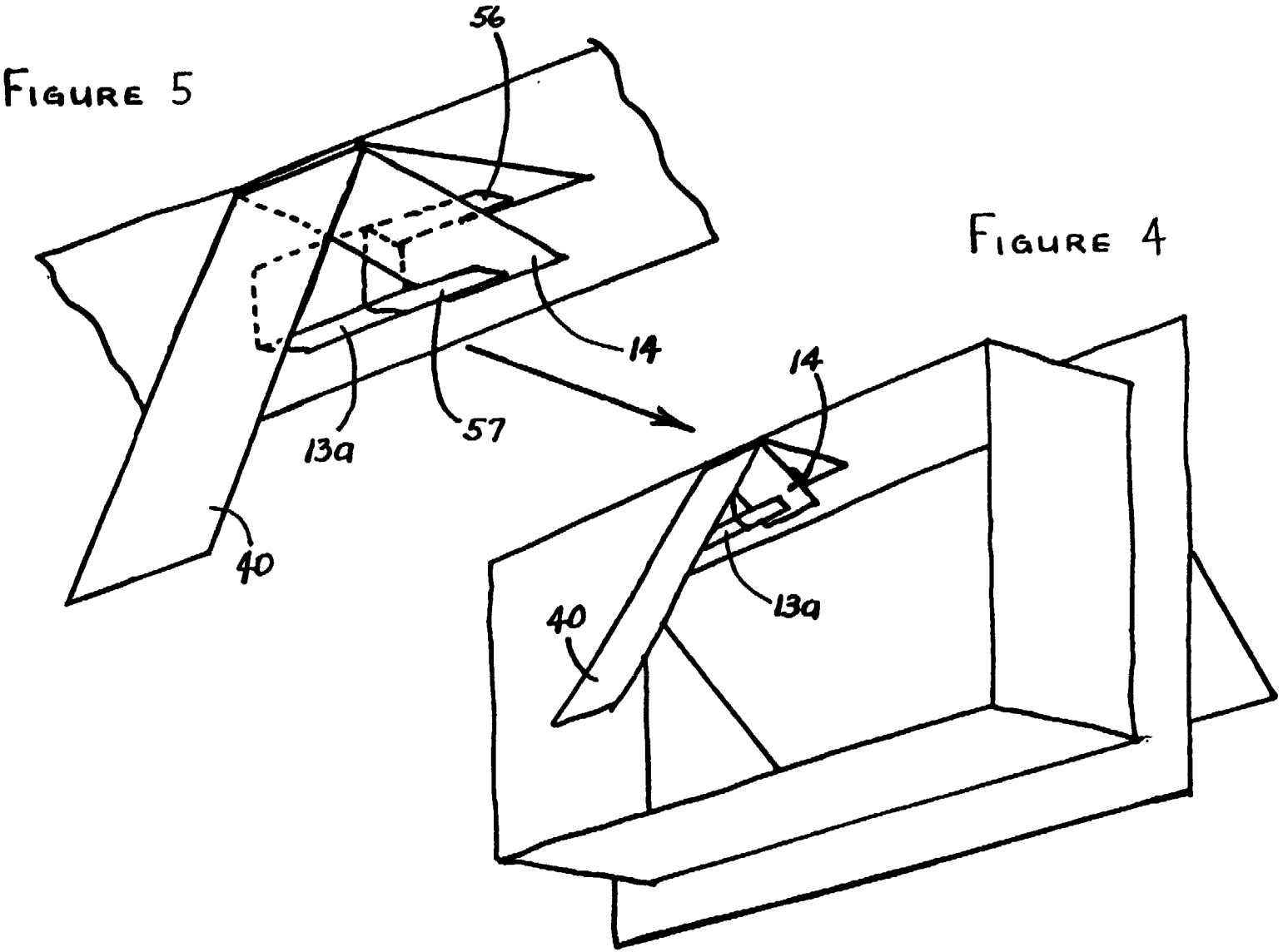
FIG. 4 is a perspective view of the conduit closure with the door open showing the placement of the pressure and air flow sensing vanes in relation to the electrical switch for the motor.
FIG. 5 is an enlarged view of the vane and switch features of FIG. 4.

Only a single switch 13*a* is required if the air flow vane 40 and pressure sensing vane 14 are integrally connected, as shown in FIGS. 4 and 5. In such a case, a pressure differential at the bleed outlet 17*a* will cause the pressure sensing vane 14 to move and activate switch 13*a*. This opens the closure 7 permitting air flow 50 to occur. The rotation of the air flow vane 40 in response to air flow 50 further biases the pressure sensing vane 14 to rotate with respect to the bleed outlet 17*a* and swing towards the position that ensures continued activation of the switch 13*a*, eliminating uncertainty.

Figure 2A:
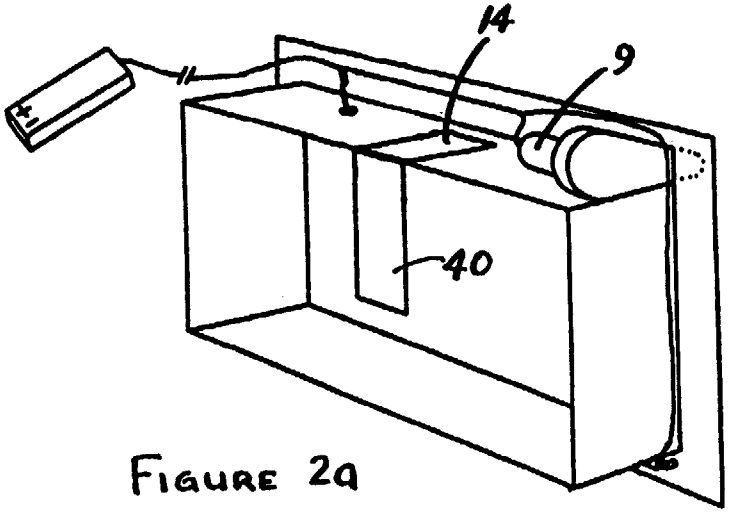
FIGS. 2*a* and 2*b* are perspective views of an exemplary conduit closure unit of the present invention, with the door or flap in a closed position.
Figure 2B:
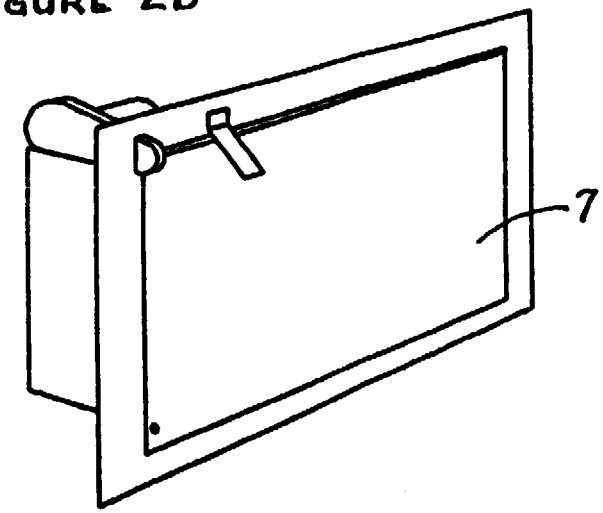

When the air flow ceases, both vanes 14, 40 return to their relaxed state, as shown in FIGS. 2*a*, 2*b* and the control system closes the closure 7.

FIGS. 4 and 5 show in enlarged detail the contact between the pressure vane 14 and upper 56 and lower 57 electrical contacts that control the motor 9. These contacts 56, 57 also serve to limit the displacement of the pressure sensing vane 14.

The use of integrally combined pressure and air-flow sensing vanes is particularly suitable when this conduit closure system is used on an air intake system. In such an arrangement, the pressure differential that may arise from the suction of an air intake system is limited to one atmosphere pressure, at the maximum. In practice much lower pressure differentials are likely to arise, and the need for an air flow sensing means to supplement the pressure-differential sensing means is greater.

CONCLUSION

The foregoing has constituted a description of specific embodiments showing how the invention may be applied and put into use. These embodiments are only exemplary. The invention in its broadest, and more specific aspects, is further described and defined in the claims which now follow.

The embodiments of the invention in which an exclusive property is claimed as follows:

1. A closure system for a ventilation conduit having a closure comprising:

(1) a motor for opening and closing the closure and a source for electrical current for said motor;

(2) electrical switch means capable of switching the current to the motor to effect either opening or closing conditions for the closure:

(3) switch actuation means comprising in combination:

(a) pressure differential sensing means for detecting whether a pressure differential condition exists between the interior of the conduit and the exterior and positioned to actuate said switch means to effect opening and closing of said closure in response to a first, pressure-differential condition, and a second, non-pressure-differential condition respectively; and (b) an air-flow sensing vane positioned to detect the presence of air-flow within said conduit and connected to actuate said electrical switch means to further bias said motor to maintain said closure in an open condition while air-flow is occurring within said conduit wherein the air-flow sensing vane and pressure differential sensing means both actuate said same electrical switch means.

2. A closure system as in claim 1 wherein said pressure differential sensing means comprises a pressure sensing vane which is connected to said air-flow sensing vane for displacement in conjunction with each other.

3. A closure system as in claim 1 in combination with a ventilation conduit that develops a reduced pressure condition within the conduit when air-flow is induced therein.

4. A closure system as in claim 2 in combination with a ventilation conduit that develops a reduced pressure condition within the conduit when air-flow is induced therein.

* * * * *